US006698152B1

(12) United States Patent
Bush

(10) Patent No.: US 6,698,152 B1
(45) Date of Patent: Mar. 2, 2004

(54) ADJUSTABLE TRUSS CONSTRUCTION

(76) Inventor: Thomas A. Bush, 11971 N. Barry Rd., Wheeler, MI (US) 48662

( * ) Notice: Subject to any disclaimer, the term of this patent is extended or adjusted under 35 U.S.C. 154(b) by 0 days.

(21) Appl. No.: 10/164,678

(22) Filed: Jun. 7, 2002

(51) Int. Cl.[7] ..... E04H 12/00

(52) U.S. Cl. ..... 52/650.1; 52/650.2; 52/653.1; 52/693

(58) Field of Search ..... 52/650.1, 650.2, 52/653.1, 664, 692, 693, 695

(56) References Cited

U.S. PATENT DOCUMENTS

| | | | | | |
|---|---|---|---|---|---|
| 2,066,388 | A | * | 1/1937 | Birkin | 52/650.1 |
| 2,855,617 | A | * | 10/1958 | Broms | 14/13 |
| 3,062,340 | A | * | 11/1962 | Hunnebeck | 52/646 |
| 3,345,793 | A | * | 10/1967 | Cvikl | 52/650.2 |
| 4,124,325 | A | | 11/1978 | Cutler | |
| 4,349,295 | A | | 9/1982 | Morrison | |
| 4,577,994 | A | | 3/1986 | Miller | |
| 4,701,071 | A | | 10/1987 | Morrison | |
| 4,931,008 | A | | 6/1990 | Morrison | |
| 4,950,101 | A | | 8/1990 | Artzberger | |
| 5,664,908 | A | | 9/1997 | Paladeni | |
| 5,871,302 | A | | 2/1999 | Carlson | |
| 6,026,626 | A | * | 2/2000 | Fisher | 52/633 |
| 6,082,068 | A | * | 7/2000 | Fisher | 52/633 |
| 6,145,269 | A | * | 11/2000 | Fisher | 52/726.2 |
| 6,321,501 | B1 | * | 11/2001 | Ignash | 52/645 |

* cited by examiner

*Primary Examiner*—Leslie A. Braun
*Assistant Examiner*—Amy J. Sterling
(74) *Attorney, Agent, or Firm*—John K. McCulloch

(57) ABSTRACT

An adjustable truss for reinforcing a floor supported atop horizontal joists has a beam which underlies the floor and includes reinforcing members having spaced apart limbs which provide space for the accommodation of utility components such as wiring, pipes, and conduits. The support members are removable from the beam so as to enable any selected support to be uncoupled from the beam and recoupled thereto following movement of the support member in such manner as to enable the utility components to be accommodated in the space between the limbs. The support members are rockable in either of two opposite direction so as to enable the beam to be adjusted in such manner as to maintain bearing engagement with the underside of the floor.

14 Claims, 2 Drawing Sheets

ADJUSTABLE TRUSS CONSTRUCTION

BACKGROUND OF THE INVENTION

Residential and commercial buildings conventionally have horizontal floors supported atop underlying, horizontal joists. The joists usually comprise elongate members fairly uniformly spaced apart and having their opposite ends supported on suitable upstanding structures such as foundation walls or the like. In the construction of the building it is customary to form the foundation and then install the joists and flooring materials. A plurality of braces usually interconnect the joists and such braces conventionally extend obliquely from the lower edge of one joist to the upper edge of an adjacent joist. Such braces serve to maintain the joists in their upright positions and minimize sagging of the joists and the overlying flooring to some extent.

Following the installation of the joists, the flooring, and the braces it is conventional to bore holes in at least some of the joists for the purpose of enabling utility components, such as wiring, water pipes, heating ducts, air passages, sewer lines, and the like to extend through such openings, thereby avoiding placing such utility components at a level below that of the lower edges of the joists. Over a period of time squeaks may develop due to uneven settling of parts of the building, sagging of some of the joists, and separation between some of the joists and the overlying flooring. The squeaks usually can be eliminated by reinforcing the flooring, and one of the best reinforcements comprises a beam which parallels the joists and spans a distance corresponding to the length of such joists. However, the installation of such a reinforcing truss between a pair of adjacent joists is extremely troublesome and time consuming if utility components of the kind referred to above span the distance between two adjacent joists where it is desired to install the reinforcing truss.

A principal object of the present invention is to provide a reinforcing truss which may be installed quickly and easily in the space between two adjacent joists and without interference with any utility components which may occupy such space.

SUMMARY OF THE INVENTION

An adjustable reinforcing truss constructed in accordance with the preferred embodiment of the invention comprises an elongate beam adapted to be interposed between a pair of spaced apart, parallel joists and mounted at its opposite ends on suitable, upstanding support members at such level that the beam underlies and bears against the lower surface of flooring supported atop the joists. Coupled to the beam is a plurality of V-shaped support members each of which comprises a pair of limbs joined at corresponding ends and diverging upwardly from one another to provide an open space between such limbs.

Each V-shaped support may be so positioned relative to the beam that any utility component which occupies the space between the two adjacent joists may be accommodated in the open space between the limbs of the support member or in the space between two adjacent supports. Once the support has been moved to a position in which the ends of the limbs are adjacent the beam, such ends may be coupled to the beam, thereby providing a unitary construction between the beam and the support members.

The joined ends of the limbs of each support are fixed so as to avoid rocking movement of one limb relative to the other. As a consequence, each support is rockable as a unit relative to the reinforcing beam so as to enable rocking movement of a support to transmit force to the flooring via the beam.

At the juncture of the joined ends of the limbs of each V-shaped support is an extension through which a threaded stabilizing rod extends. The stabilizing rod carries adjacent each extension a pair of correspondingly threaded adjusting nuts. The two adjusting nuts are operable in conjunction with one another to apply on the associated support via its extension forces to effect rocking movement of such support in a selected one of two opposite directions so as to exert vertical forces on the beam and, through the latter, to the flooring.

The construction and arrangement of the beam, the support members, the stabilizing rod, and the adjusting nuts are such as to enable adjustment of the individual supports relative to one another in such directions as to provide reinforcement of the flooring to overcome sagging and squeaking.

THE DRAWINGS

A preferred embodiment of the truss construction is illustrated in the accompanying drawings wherein.

THE PREFERRED EMBODIMENT

Figure 1:
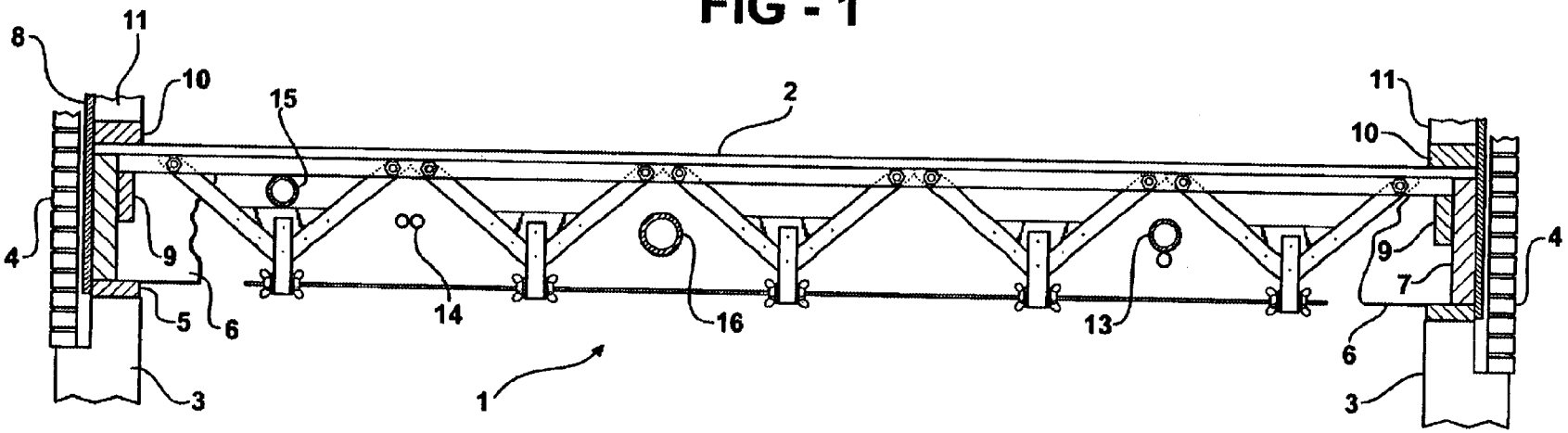
FIG. 1 is a view partly in elevation and partly in section of a reinforcing truss installed between a pair of parallel, spaced apart joists and in underlying engagement with a floor supported on such joists.

An adjustable truss constructed in accordance with the presently preferred embodiment of the invention is designated generally by the reference character 1 and is adapted to be installed beneath the floor 2 of a building having upstanding foundation walls 3 on which is supported an exterior brick or other wall 4, horizontal bearing members 5, and a plurality of parallel, horizontal, spaced apart joists 6 which span the foundation members 3 and underlie and support the floor 2. Perimeter members 7 are mounted on the bearing members 5 and provide support for external insulation 8 and supports 9 for the opposite ends of the reinforcing truss 1.

In a typical installation the flooring 2 may be sheets of plywood or particle board which normally rest directly upon the upper surfaces of the joists 6. In some instances floorboards, linoleum, or other material (not shown) may rest upon the upper surface of the flooring material 2. In some instances a base 10 overlies the marginal edges of the flooring 2 for supporting vertical studs 11.

Over a period of time the joists or the flooring 2 may shift relative to one another so that a gap exists between some part of the flooring and the upper surfaces of the joists. This may be due to warping of the joists or flooring, uneven settling of some parts of the foundation walls, or some other reason. In any event, the presence of the gap makes possible vertical movement of the flooring relative to the zone where such gap exists. In such cases subjecting the flooring above the gap to downwardly directed forces, such as occur when a person walks across the flooring, may cause squeaking and such squeaking not only is annoying, but also can lead to deterioration of rugs, carpets, linoleum, and tile overlying the flooring.

When squeaking of a floor in response to a person's walking across it occurs, it is not unusual to attempt to overcome the squeaking by reinforcing the flooring so as to prevent or minimize relative movement of the flooring and the supporting joists. However, if utility components are supported by the joists and extend through openings formed in the latter, as is customary, difficulties are encountered in reinforcing the flooring in the necessary areas. Examples of utility components that frequently are supported by joists include water pipes 13, electrical wiring 14, conduits 15, and sewer lines 16. The listed components are not exhaustive; others may be included. In any event, such components conventionally span a space between adjacent joists and, therefore, prevent the installation of a truss structure unless the components are cut and subsequently spliced. These problems are overcome by the reinforcing truss disclosed herein.

The preferred embodiment of a reinforcing truss comprises an elongate beam 18 which can be a single member, but preferably is composed of a pair of parallel, spaced apart rails 19 and 20 each of which has a plurality of longitudinally spaced openings 22. The dual rails minimize any tendency of the part of the beam to twist. The truss also includes a plurality of V-shaped support members 24, all of which are alike. Each support member has a pair of limbs 25 and 26 joined at corresponding ends by a junction block 27 having upstanding and depending extensions 28 and 29, respectively. Fixed to the upstanding extension 28 and to each of the limbs 25 and 26 is a brace 30 which rigidifies the assembly of the limbs and junction block. The ends 31 and 32 of the limbs 25 and 26, that is, those ends which are remote from the junction block 27, are provided with openings 33 and 34. The bore size of the openings 33 and 34 corresponds to the bore size of the openings 22.

The braces 30 are accommodated in slots in the limbs 25 and 26 and in the extension 28. Pins 35 secure the braces to the limbs and extension.

Figure 3:
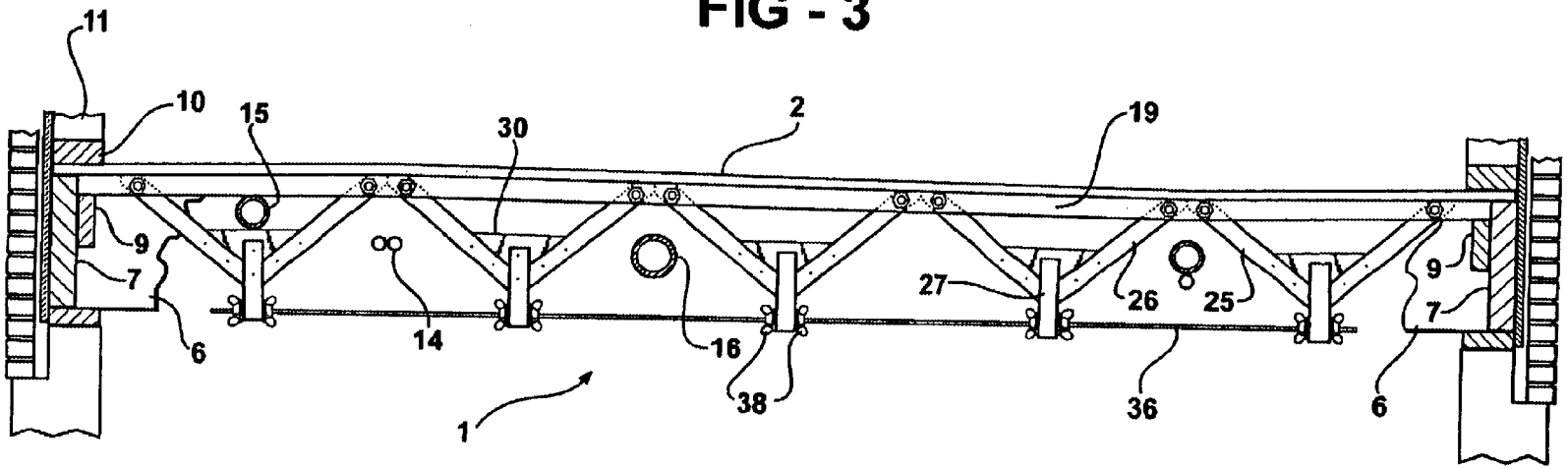
FIG. 3 is a view similar to FIG. 1, but illustrating the truss in adjusted condition.
Figures 2, 4:
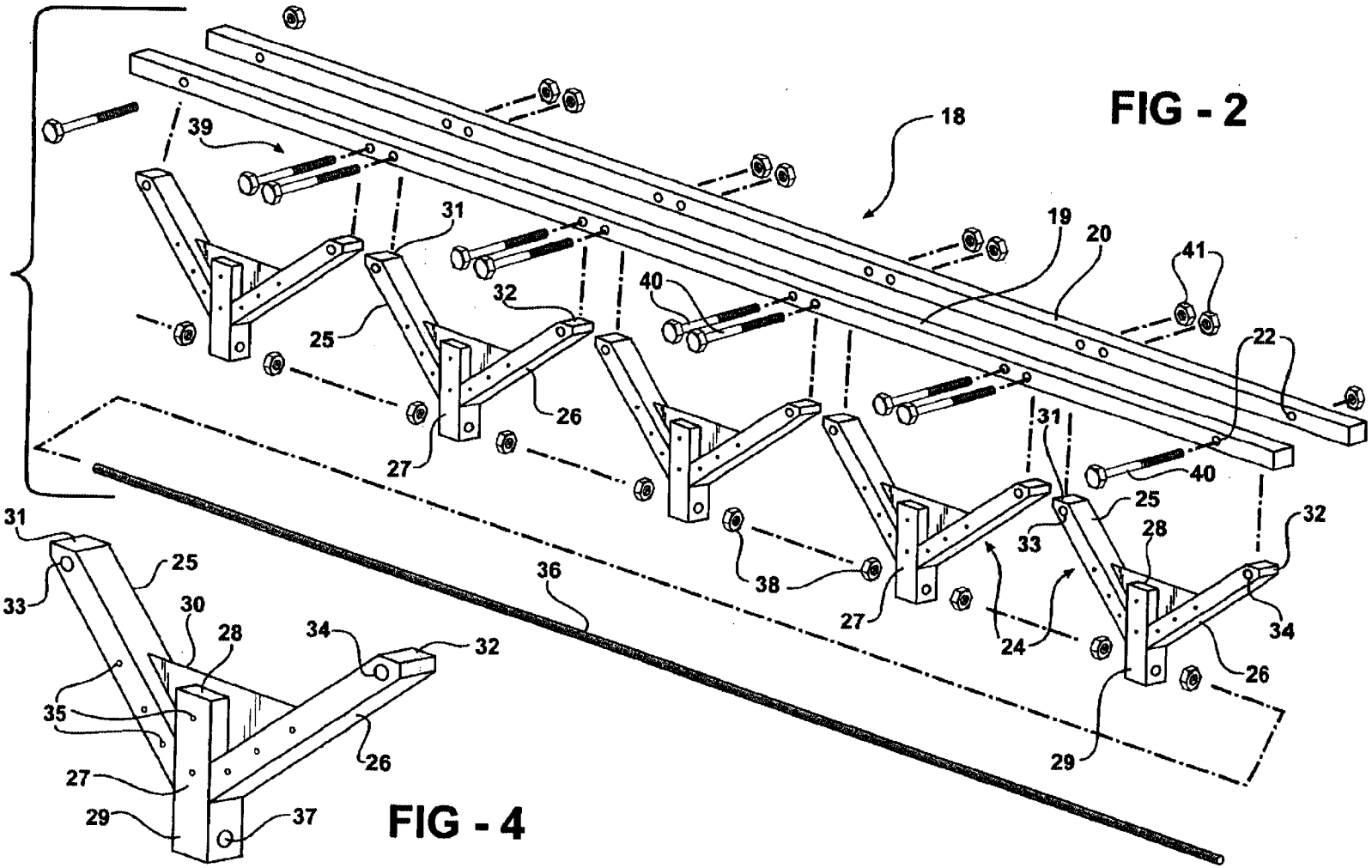
FIG. 2 is an exploded, isometric view of the reinforcing truss.
FIG. 4 is an isometric, enlarged view of one of the V-shaped supports.

The adjustable truss construction also includes a threaded stabilizing rod 36 which extends through an opening 37 formed in the depending extension 29 of each of the supports 24. On opposite sides of each of the extensions 29 is an adjusting nut 38 which bears against the extension 29 and is adjustable longitudinally of the rod 36. The actuating nuts may be flat, as indicated in FIG. 2 or wingnuts as indicated in FIGS. 1 and 3.

Coupling means 39 is provided for removably coupling the supports 24 to the beam 18. In the form shown, the coupling means comprises a headed, threaded bolt 40 which may be extended through any selected opening 22, 33, and 34. Each bolt 40 includes a locking nut 41.

To condition the apparatus for use, the beam members 19 and 20 are positioned between a pair of joists 6 and parallel thereto so as to underlie the flooring 2 at a zone where the flooring has been distorted or squeaks. The beam-forming members 19 and 20 are of sufficient length to enable the mounting surfaces at their opposite ends to rest upon the abutments or supports 9 and span the distance therebetween. Following placement of the beam a selected number of supports 24 may be assembled with the beam by aligning the openings 33 and 34 in the adjacent limbs with the appropriate openings in the beam members and extending the bolts 40 through the openings whereupon the supports 24 are suspended from the beam. If any utility components underlie the flooring at the zone where the supports 24 are required, the open space between the limbs 25 and 26, and the open space between adjacent supports, enable the utility components to be accommodated in such spaces as the supports are moved into coupled relation with the beam, thereby avoiding any interference between the supports 24 and the utility components.

When the supports 24 are coupled to the beam they form a plurality of triangles at the apex of each of which is the junction block 27. The stabilizing rod 36 may be extended through the openings 37 with the nuts 38 straddling the extensions 29. It then is possible to manipulate the adjusting nuts in such manner as to rock any selected one of the supports either clockwise or counterclockwise, as viewed in FIG. 1, thereby enabling the associated portions of the beam 18 to be deflected vertically upwardly or downwardly as may be required to cause the beam to bear against the lower surface of the flooring 2 and provide auxiliary support therefor.

In cases in which there is severe warping or sagging of the flooring and joists, some of the support members coupled to the single beam 18 may be rocked clockwise, whereas others may be rocked counterclockwise as may be required to provide adequate support for the floor.

The components of the truss may be formed of wood, metal, or suitable plastic materials so as to provide appropriate flexibility for the beam members 18 and 19 with adequate strength for the limbs 25 and 26.

The disclosed embodiment is representative of the presently preferred form of the invention, but is intended to be illustrative rather than definitive thereof. The invention is defined in the claims.

I claim:

1. An adjustable truss construction comprising an elongate beam having opposite ends;

a plurality of supports, each of said supports comprising a pair of limbs each of which has opposite ends, corresponding ends of each pair of said limbs being joined to one another and the other ends of each pair of said limbs being spaced apart whereby each of said supports has a V-shaped configuration;

coupling means pivotally coupling the other ends of each of said limbs to said beam between the opposite ends thereof;

stabilizing means spanning all of said supports adjacent the corresponding ends thereof; and adjusting means reacting between said stabilizing means and selected ones of said supports for adjusting the positions of said selected ones of said supports relative to one another independently of others of said supports and thereby deflecting those portions of said beam adjacent the selected ones of said supports.

2. The construction according to claim 1 wherein the coupling means is separable from said beam thereby enabling said supports to be separated from said beam and recoupled thereto.

3. The construction according to claim 1 wherein said stabilizing means comprises a threaded rod and wherein said adjusting means comprises correspondingly threaded nuts on said rod on opposite sides of each of said supports.

4. The construction according to claim 1 wherein the opposite ends of said beam have mounting surfaces for mounting said beam on spaced apart abutments.

5. The construction according to claim 1 wherein said beam comprises a pair of spaced apart, parallel members and wherein said other ends of said limbs are accommodated between said parallel members.

6. An adjustable truss construction underlying and reinforcing a building floor supported atop a plurality of elongate, spaced apart, substantially parallel joists, said joists also providing support for utility components such as wiring, ducts, and conduits which extend transversely of said joists, said truss construction comprising an elongate beam having opposite ends mounted on supports positioned in such manner as to enable said beam to extend parallel to said joists and between an adjacent pair thereof in underlying engagement with said floor; a plurality of V-shaped supports each of which has an open end confronting said floor, a closed end remote from said floor, and an open space between said open and closed ends; separable coupling means separably coupling the open ends of said supports to said beam at longitudinally spaced intervals, the separability of said coupling means enabling any of said supports to be assembled with and disassembled from said beam and thereby enable said utility components to pass through the open space of said supports; stabilizing means spanning the closed ends of all of said supports; and adjusting means reacting between said stabilizing means and selected ones of said supports for effecting movement thereof relative to and independently of others of said supports to deflect said beam adjacent said selected ones of said supports in a direction to apply an upwardly directed force on said floor.

7. The construction according to claim 6 wherein said beam comprises a pair of parallel, spaced apart members, said supports being accommodated between said members.

8. The construction according to claim 6 wherein said separable coupling means pivotally couples said supports to said beam.

9. The construction according to claim 6 wherein each of said supports forms a triangle having an apex and wherein said stabilizing means extends through the apex of each said triangle.

10. The construction according to claim 9 wherein said stabilizing means comprises a threaded rod and wherein said adjusting means comprises correspondingly threaded nuts carried by said rod for movements relative thereto.

11. The construction according to claim 6 wherein each said support comprises a pair of limbs joined at corresponding ends and diverging from said corresponding ends at such an angle that those ends of said limbs remote from said corresponding ends are spaced from one another.

12. The construction according to claim 11 including a brace between said limbs adjacent said corresponding ends thereof.

13. The construction according to claim 11 wherein the angle at which said limbs diverge is no greater than 90°.

14. The construction according to claim 11 wherein said limbs diverge at substantially a right angle.

* * * * *